US011195680B2

(12) United States Patent
Lee et al.

(10) Patent No.: US 11,195,680 B2
(45) Date of Patent: Dec. 7, 2021

(54) ELECTRICAL ASSEMBLY WITH CONTACTS WITH MODIFIED MATING SURFACES

(71) Applicant: TE CONNECTIVITY CORPORATION, Berwyn, PA (US)

(72) Inventors: Albert Yong Lee, Greensboro, NC (US); Roger Lee Thrush, Clemmons, NC (US)

(73) Assignee: TE Connectivity Services GmbH

( * ) Notice: Subject to any disclaimer, the term of this patent is extended or adjusted under 35 U.S.C. 154(b) by 182 days.

(21) Appl. No.: 16/359,284

(22) Filed: Mar. 20, 2019

(65) Prior Publication Data

US 2020/0303144 A1 Sep. 24, 2020

(51) Int. Cl.

| | |
|---|---|
| ***H01H 1/06*** | (2006.01) |
| ***H01H 50/14*** | (2006.01) |
| ***H01H 50/18*** | (2006.01) |

(52) U.S. Cl.

CPC ..... *H01H 50/14* (2013.01); *H01H 50/18* (2013.01); *H01H 2205/004* (2013.01)

(58) Field of Classification Search

CPC .... H01H 1/06; H01H 1/20–2001/2091; H01H 50/546

See application file for complete search history.

(56) References Cited

U.S. PATENT DOCUMENTS

2019/0019645 A1* 1/2019 Lee ..... H01H 50/60

FOREIGN PATENT DOCUMENTS

| | | | |
|---|---|---|---|
| JP | S4330981 | Y1 | 12/1968 |
| JP | S52108575 | U | 8/1977 |
| JP | 2008311159 | A | 12/2008 |
| WO | 2014093045 | A1 | 6/2014 |
| WO | 2017033678 | A1 | 3/2017 |
| WO | 2020031068 | A1 | 2/2020 |

OTHER PUBLICATIONS

International Search Report, International Application No. PCTIB2020/052312, International Filing Date, Mar. 20, 2019.

* cited by examiner

*Primary Examiner* — Ramon M Barrera

(57) ABSTRACT

An electrical assembly adapted for switching power to a circuit having a power source. The electrical assembly includes a housing with current carrying contacts disposed in the housing. The current carrying contacts have engagement ends with non-linear surfaces. A coupling member is provided in the housing. The coupling member has mating portions for engaging the non-linear surfaces of the current carrying contacts. The mating portions have grooves provided thereon which extend from top surfaces of the mating portions toward bottom surfaces of the mating portions. As the electrical assembly is moved to a closed position, the grooves of the mating portions of the coupling member are moved into engagement with the non-linear surfaces of the contacts, resulting in multiple contact points being provided between the non-linear surfaces of each respective contact of the current carrying contacts and edges each respective groove of the groove of the mating portions.

19 Claims, 4 Drawing Sheets

ELECTRICAL ASSEMBLY WITH CONTACTS WITH MODIFIED MATING SURFACES

FIELD OF THE INVENTION

The present invention is directed an electrical assembly adapted for switching power to a circuit having a power source. In particular, the invention is directed to an electrical assembly having contacts with modified mating surfaces to minimize or eliminate the effects of the contaminants on the mating surfaces.

BACKGROUND OF THE INVENTION

Relays and contactors are known devices used for switching of intended circuits/loads and the like. A relay is an electrically operated switch. Many known relays use an electromagnet to operate a switching mechanism mechanically, but other operating principles are also used. Relays are used where it is necessary to control a circuit by a low power signal or where several circuits must be controlled by one signal. A contactor is an electrically controlled switch used for switching a power circuit, similar to a relay except with higher current ratings.

In general, a simple electromagnetic relay consists of a coil assembly, a movable armature and one or more sets of contacts, i.e. single throw system, double throw system, etc. The sets of contact include movable contacts and fixed contacts. The armature is mechanically linked to one or more sets of moving contacts and is held in place by a spring.

When an electric current is passed through the coil assembly it generates a magnetic field that attracts the armature. The consequent movement of the movable contact(s) either makes or breaks (depending upon construction) a connection with a fixed contact(s). If the set of contacts was closed when the relay was de-energized, then the movement opens the contacts and breaks the connection, and vice versa if the contacts were open. When the current to the coil is switched off, the armature is returned by the spring force of the return spring toward its relaxed position.

When the movable contacts and fixed contacts are moved to the mated or closed position, the mating surfaces of the of the contacts engage to provide an electrical connection therebetween. However, if contaminants (such as particles as small as 40 microns) are present on the mating surface of the movable contacts or the fixed contacts, the contaminants may: prevent the electrical connection; cause an unreliable electrical connection; or cause the contacts to have a high resistance when the movable and fixed contacts are in the mated or closed position.

It would, therefore, be beneficial to provide contacts which have modified mating surfaces to minimize or eliminate the effects of the contaminants, thereby insuring that a positive electrical connection is when the movable contacts and fixed contacts are mated, regardless of whether contaminants are present or not.

SUMMARY OF THE INVENTION

An embodiment is directed to an electrical assembly adapted for switching power to a circuit having a power source. The electrical assembly includes a housing with current carrying contacts disposed in the housing. The current carrying contacts have engagement ends with non-linear surfaces. A coupling member is provided in the housing. The coupling member has mating portions for engaging the non-linear surfaces of the current carrying contacts. The mating portions have grooves provided thereon, the groves extend from top surfaces of the mating portions toward bottom surfaces of the mating portions. As the electrical assembly is moved to a closed position, the grooves of the mating portions of the coupling member are moved into engagement with the non-linear surfaces of the contacts, resulting in multiple contact points being provided between the non-linear surfaces of each respective contact of the current carrying contacts and edges each respective groove of the groove of the mating portions.

An embodiment is directed to a contactor assembly adapted for switching power to a circuit having a power source. The electrical assembly includes a housing, current carrying contacts, a coupling member and an actuator assembly. The current carrying contacts are disposed in the housing and have engagement ends with non-linear surfaces. The coupling member has mating portions for engaging the non-linear surfaces of the current carrying contacts. The mating portions have grooves which extend from top surfaces of the mating portions toward bottom surfaces of the mating portions. The actuator assembly is provided in the housing and moves the coupling member between a closed position in which the mating portions of the coupling member are engaged with the current carrying contacts and an open position in which the mating portions of the coupling member are disengaged from the current carrying contacts. As the electrical assembly is moved to the closed position, the grooves of the mating portions of the coupling member are moved into engagement with the non-linear surfaces of the contacts, resulting in multiple contact points being provided between the non-linear surfaces of each respective contact of the current carrying contacts and edges each respective groove of the grooves of the mating portions.

An embodiment is directed to a switch assembly adapted for switching power to a circuit having a power source. The switch assembly includes fixed contacts and a movable coupling member. The fixed contacts have engagement ends with non-linear surfaces. The movable coupling member has mating portions for engaging the non-linear surfaces of the fixed contacts. The mating portions have grooves provided thereon. The groves have contact edges. The movable coupling member is movable between an open position in which the mating portions of the movable coupling member are disengaged from the fixed contacts and a closed position in which the mating portions of the movable coupling member are engaged with the fixed contacts. As the switch assembly is moved to the closed position, the contact edges of the mating portions of the movable coupling member are moved into engagement with the non-linear surfaces of the fixed contacts, resulting in multiple contact points being provided between the non-linear surfaces of each respective contact of the fixed contacts and the contact edges each respective groove of the grooves of the mating portions.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
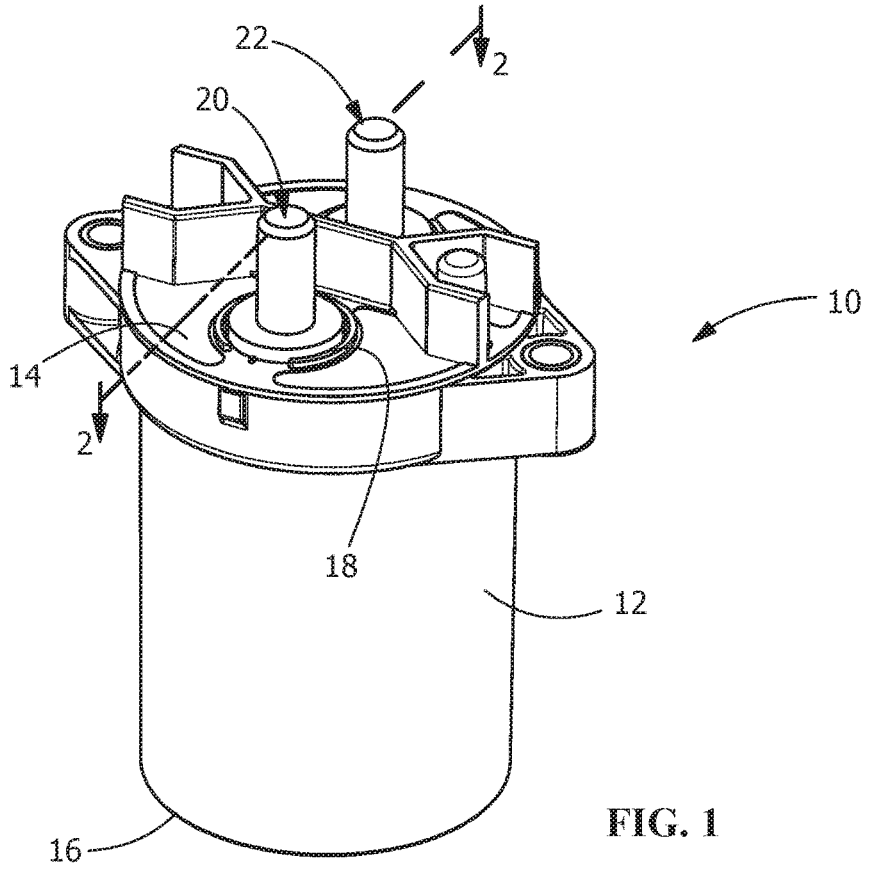
FIG. 1 is a perspective view of an illustrative contactor assembly.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

Figure 2:
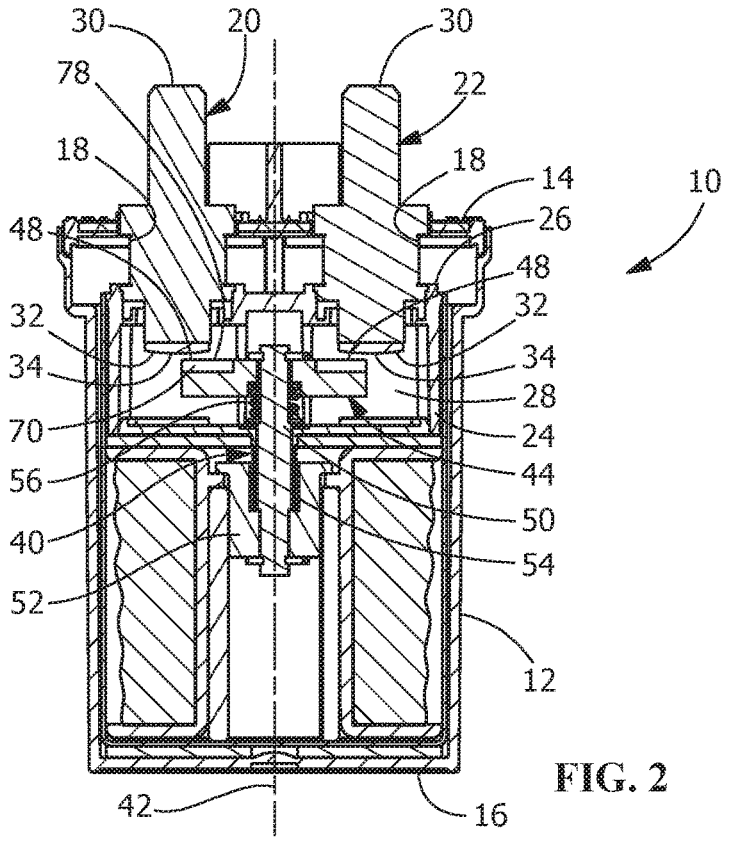
FIG. 2 is a cross-sectional view of the illustrative contactor assembly taken along the line 2-2 of FIG. 1, showing the contactor assembly is an open position.
Figure 3:
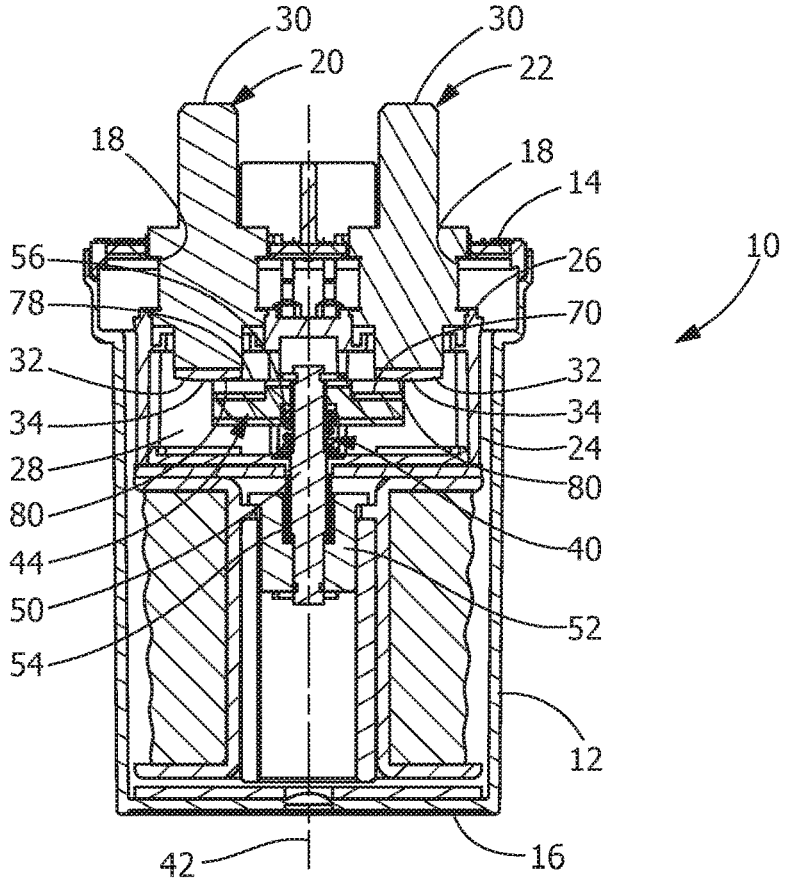
FIG. 3 is a cross-sectional view of the illustrative contactor assembly, similar to that of FIG. 2, showing the contactor assembly is a closed position.
Figure 4:
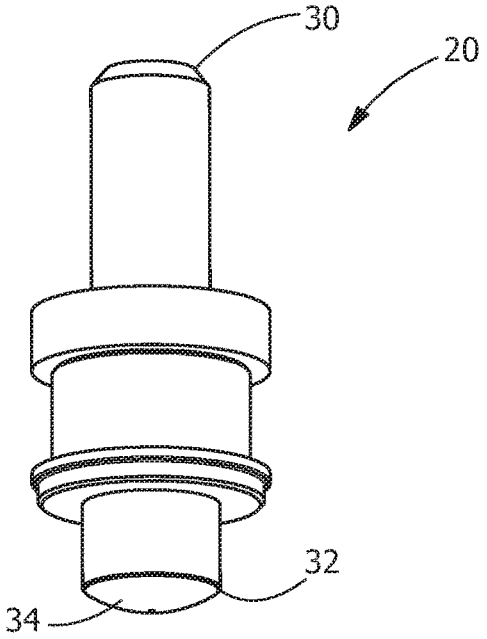
FIG. 4 is an enlarged perspective view of an illustrative fixed contact of the contactor assembly.

The contactor assembly 10 is a relay or switch that controls the delivery of power through a circuit (not shown). The contactor assembly 10 alternates between an open state (as shown in FIG. 2) and a closed state (as shown in FIG. 3). In a closed state, the contactor assembly 10 provides a conductive bridge in order to close the circuit and permit current to be supplied from a power source to an electrical load. In the open state, the contactor assembly 10 removes the conductive bridge such that the circuit is opened and current cannot be supplied from the power source to the electrical load via the contactor assembly 10.

The illustrative contactor assembly 10 shown in FIGS. 1-3 includes an outer housing 12 that extends between opposite ends 14, 16 of the contactor assembly 10. While the outer housing 12 is shown in the approximate shape of a cylindrical can, the outer housing 12 may have a different shape. The outer housing 12 may include, or be formed from, a dielectric material such as one or more polymers. In another embodiment, the outer housing 12 may include or be formed from conductive materials, such as one or more metal alloys.

The end 14 of the housing 12 includes several openings 18 through which current carrying contacts 20, 22 extend. The contacts 20, 22 extend through the openings 18 to mate with conductive bodies, such as bus bars, that are joined with the circuit.

As best shown in FIGS. 2 and 3, the contactor assembly 10 includes an inner housing 24 disposed within the outer housing 12. The contacts 20, 22 protrude through an end 26 of the inner housing 24. The inner housing 24 may include, or be formed from, a dielectric material such as one or more polymers. The inner housing 24 includes an interior chamber or compartment 28.

Portions of the contacts 20, 22 are disposed in the interior chamber or compartment 28. The interior chamber or compartment 28 may be sealed and loaded with an inert and/or insulating gas, such as, but not limited to, sulphur hexafluoride, nitrogen and the like. The interior chamber or compartment 28 is sealed so that any electric arc extending from the contacts 20, 22 are contained within the interior chamber or compartment 28 and do not extend out of the interior chamber or compartment 28 to damage other components of the contactor assembly 10 or circuit.

The contactor assembly 10 shown and described herein is provided for illustrative purposes. The configuration of the contactor assembly 10 and its components may vary without departing from the scope of the invention.

As best shown in FIGS. 2-4 and 6, the contacts 20, 22 are elongated bodies that extend between circuit mating ends 30 and engagement ends 32. The circuit mating ends 30 couple with the circuit to electrically couple the contactor assembly 10 with the circuit. In the illustrated embodiment, the engagement ends 32 have non-linear surfaces 34, such as a curved or arcuate surface 34. The non-linear surfaces 34 may be, but are not limited to, rounded, arcuate, curved, triangular, spherical, conical, or pyramidal. The non-linear surfaces 34 are formed from a conductive material such as, but not limited to, one or more metals or metal alloys. For example, the non-linear surfaces 34 may be formed from a silver (Ag) alloy. The use of a silver alloy may prevent the non-linear surfaces 34 from welding to a mating contact. Alternatively, the non-linear surfaces 34 may be made from softer material, such as, but not limited to, copper or copper alloys.

In the illustrative embodiment shown in FIGS. 2 and 3, an actuator subassembly 40 moves along or in directions parallel to a longitudinal axis 42 of the contactor assembly 10 to electrically couple contacts 20, 22 with one another. The actuator subassembly 40 includes a coupling member 44.

Figure 5:
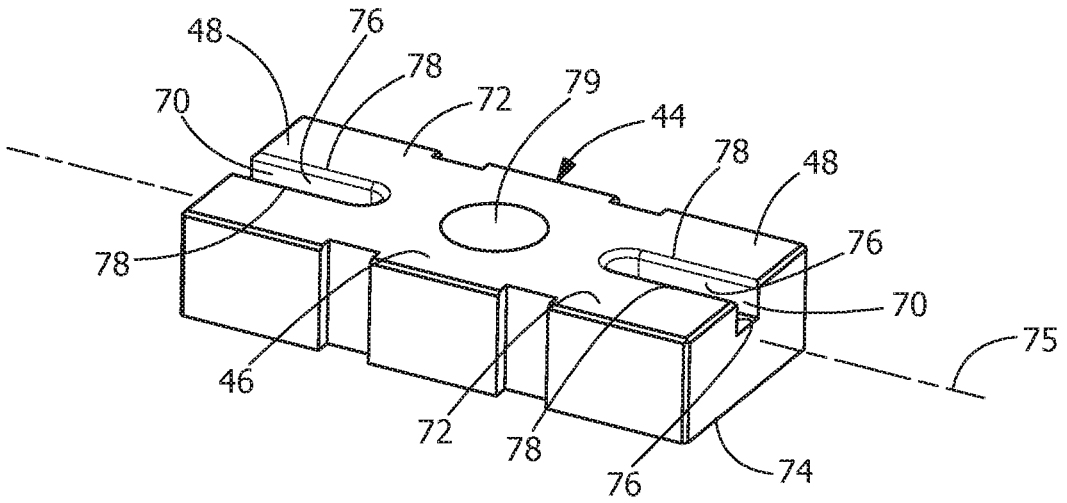
FIG. 5 is an enlarged perspective view of an illustrative movable contact of the contactor assembly.

The coupling member 44, as best shown in FIG. 5, has a contact bridge 46 with mating portions or contact pads 48 provided at either end thereof. The coupling member 44 is formed from a conductive material such as, but not limited to, one or more metals or metal alloys. The mating portions 48 are formed from a conductive material such as, but not limited to, one or more metals or metal alloys. For example, the mating portions 48 may be formed from a silver (Ag) alloy. The use of a silver alloy may prevent the mating portions 48 from welding to the non-linear surfaces 34. Alternatively, the mating portions 48 may be made from softer material than that of the coupling member 44, such as, but not limited to, copper or copper alloys.

Figure 6:
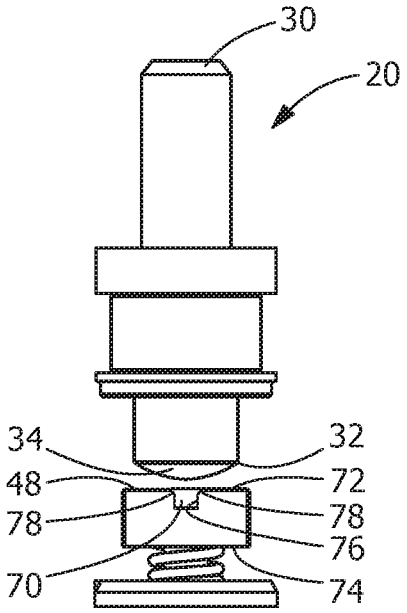
FIG. 6 is an enlarged side view of the fixed contact and the movable contact in the open or unmated position.
Figure 7:
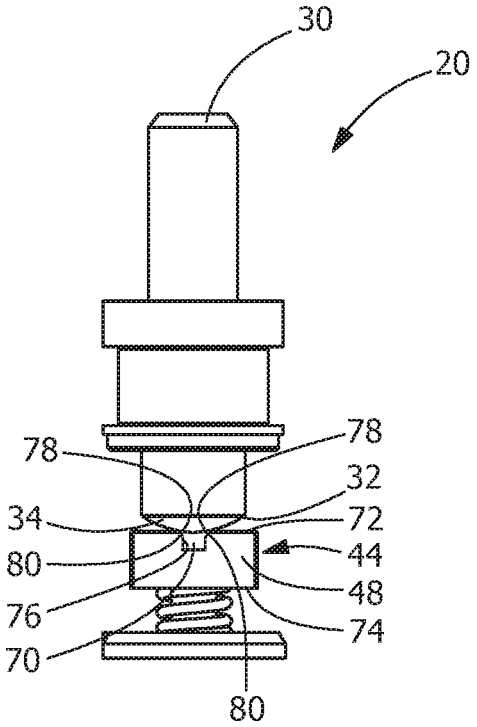
FIG. 7 is an enlarged side view of the fixed contact and the movable contact in the closed or mated position.
Figure 8:
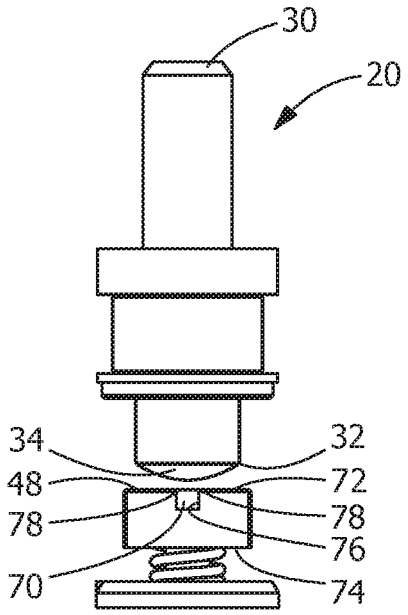
FIG. 8 is an enlarged side view of the fixed contact and an alternate embodiment of the movable contact in the open or unmated position.

The mating portions 48 have grooves or slots 70 which extend from top surfaces 72 of the mating portions 48 toward bottom surfaces 74 of the mating portions 48. The grooves 70 may extend in a direction which is parallel to a longitudinal axis of the coupling member 44, in a direction which is perpendicular to a longitudinal axis 75 of the coupling member 44, or at any other angle relative to the longitudinal axis of the coupling member 44. The grooves 70 have side walls 76 which extend to the top surfaces 72 of the mating portions 48. The intersection of the side walls 76 and top surfaces 72 form contact edges 78. In the illustrative embodiment, the contact edges 78 are curved or rounded edges which extend between the side walls 76 and the top surfaces 72, as shown in FIGS. 6 and 7. In other embodiments, as shown in FIG. 8, the side walls 76 may extend at 90 degree angles from the top surfaces 72 to form the contact edges 78. Other configurations of the edges 78, such as, but not limited to, trapezoidal, may also be used. An opening 79 is provided in the center of the coupling member 44.

The actuator subassembly 40 moves in opposing directions along the longitudinal axis 42 to move the coupling member 44 toward the contacts 20, 22 (closed position, FIG. 3) and away from the contacts 20, 22 (open position, FIG. 2).

The mating of the mating portions 48 of the coupling member 44 with the non-linear surfaces 34 of the contacts 20, 22 causes the current to flow across the coupling member 44 of the actuator subassembly 40, thereby closing the circuit. In the illustrated embodiment, the mating portions 48 and the coupling member 44 electrically joins the contacts 20, 22 with one another such that current may flow through the non-linear surfaces 34 of the contacts 20, 22, through the mating portion 48 and across the contact bridge 46. The current may flow in either direction.

FIG. 2 is a cross-sectional view of the contactor subassembly 10 in an open state in accordance with one embodiment of the present disclosure. The actuator subassembly 40 includes an elongated shaft or armature 50 that is oriented along the longitudinal axis 42. The armature 50 extends through the opening 79 of the coupling member 44. The coupling member 44 is joined to the shaft or armature 50 at one end using a clip or other known method. The contactor assembly 10 is in an open state because the actuator subassembly 40 is decoupled from contacts 20, 22. The actuator subassembly 40 is separated from the contacts 20, 22 such the coupling members 44 does not interconnect or electrically connect the contacts 20, 22 with one another. As a result, current cannot pass across the contacts 20, 22.

In the illustrative embodiment shown, the actuator subassembly 40 includes a magnetized body 52 coupled to the shaft or armature 50. The body 52 may include a permanent magnet that generates a magnetic field or flux oriented along the longitudinal axis 42. The contactor assembly 10 includes a coil body 54 that encircles the body 52. The coil body 54 may be used as an electromagnet to drive the magnetic body 52 of the shaft 50 along the longitudinal axis 42. For example, the coil body 54 may include conductive wires or other components that encircle the magnet body 52. An electric current may be applied to the coil body 54 to create a magnetic field that is oriented along the longitudinal axis 42. Depending on the direction of the current passing through the coil body 54, the magnetic field induced by the coil body 54 may have magnetic north oriented toward the end 14 of the outer housing 12 or toward the end 16.

In order to drive the actuator subassembly 40 toward the contacts 20, 22, the coil body 54 is energized to create a magnetic field along the longitudinal axis 42. The magnetic field may move the magnet body 52 of the actuator assembly 40 toward the contacts 20, 22 along the longitudinal axis 42. In the illustrated embodiment, an armature spring 56 exerts a force on the armature 50 in a downward direction toward the end 16 of the outer housing 12. The force exerted by the armature spring 56 prevents the actuator subassembly 40 from moving toward and mating with the contacts 20, 22 without the creation of a magnetic field by the coil body 54. The magnetic field generated by the coil body 54 is sufficiently large or strong so as to overcome the force exerted on the armature 50 by the armature spring 56 and drive the armature 50 and the actuator subassembly 40 and the coupling member 44 toward the contacts 20, 22.

FIG. 3 is a cross-sectional view of the contactor assembly 10 in a closed state in accordance with one embodiment of the present disclosure. In the closed state, the actuator subassembly 40 has moved within the coupling member 44 along the longitudinal axis 42 sufficiently far that the mating portions 48 of the coupling member 44 are mated with non-linear surfaces 34 of the contacts 20, 22. As a result, the actuator subassembly 40 has electrically coupled contacts 20, 22 to close the circuit.

In the closed position, the current flows through non-linear surface 34 of contact 20, through the first mating portion 48, across contact bridge 46, through the second contact mating portion 48 and through non-linear surfaces 34 of contact 22.

As the contactor assembly 10 is moved to the closed position, the mating portions 48 of the coupling member 44 are moved into engagement with the non-linear surfaces 34 of the contacts 20, 22. The shape of the non-linear surfaces 34 and the positioning of the grooves 70 in the mating portions 48 results in multiple (two or more) contact points 80 being provided between the non-linear surfaces 34 of the contacts 20, 22 and the edges 78 of the grooves 70 of the mating portion 48 (as best shown in FIG. 7).

As a result, some portions of the non-linear surface 34 and the mating portions 48 are not in contact or engagement with each other. Therefore, any contaminants or particles that are attached to the non-linear surfaces 34 and the mating portions 48 do not interfere or prevent the contact points 80 from being moved into engagement to secure a proper electrical connection therebetween.

In contrast, known contacts and mating portions of the coupling members have linear surfaces which are essentially parallel to each other. Consequently, any contaminant (such as particles as small as 40 microns) positioned anywhere along the surface of either the contact or the mating portion of the coupling member will prevent the contact and the mating portion of the coupling member from moving to the fully mated or closed position, thereby preventing the electrical connection, causing an unreliable electrical connection or causing the contacts to have a high resistance when the movable and fixed contacts.

As best shown in FIG. 7, the configuration of the non-linear surfaces 34 of the contact 20, 22 and the edges 78 of the groove or slot 70 of the mating portions 48 allow the edges 78 to pierce, break or penetrate any contaminant that may be present in the contact points 80. In addition, the redundancy of multiple contact points 80 provided on each contact 20, 22 also insures that a proper electrical connection is affected.

While the non-linear surfaces 34 and the grooves 70 are shown with respect to the illustrative contacts 20, 22 and mating portions 48 of coupling member 44, the non-linear surfaces 34 and the grooves 70 can be used for fixed and movable contacts of other configuration is other devices, such as, but not limited to, switches and relays.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical assembly adapted for switching power to a circuit having a power source, the electrical assembly comprising:

a housing;

current carrying contacts disposed in the housing, the current carrying contacts having engagement ends with non-linear surfaces;

a coupling member, the coupling member having mating portions for engaging the non-linear surfaces of the current carrying contacts, the mating portions having grooves provided thereon, the groves extending from top surfaces of the mating portions toward bottom surfaces of the mating portions, the grooves having side walls extending to the top surfaces of the mating portions, the intersections of the side walls and top surfaces form contact edges;

wherein as the electrical assembly is moved to a closed position, the grooves of the mating portions of the coupling member are moved into engagement with the non-linear surfaces of the contacts, resulting in multiple contact points being provided between the non-linear surfaces of each respective contact of the current carrying contacts and the contact edges of each respective groove of the grooves of the mating portions, the contact edges are configured to pierce, break or penetrate contaminants that may be present at the multiple contact points.

2. The electrical assembly of claim 1, wherein the non-linear surfaces have a rounded configuration.

3. The electrical assembly of claim 1, wherein the grooves extend in a direction which is parallel to a longitudinal axis of the coupling member.

4. The electrical assembly of claim 1, wherein the side walls extend at 90 degree angles from the top surfaces to form the contact edges.

5. The electrical assembly of claim 1, wherein the contact edges are rounded edges which extend between the side walls and the top surfaces.

6. The electrical assembly of claim 1, wherein a contact bridge extends from a first mating portion of the mating portions of the coupling member to a second mating portion of the mating portions of the coupling member.

7. The electrical assembly of claim 1, wherein an actuator assembly moves the coupling member between the closed position and an open position in which the mating portions of the coupling member are disengaged from the current carrying contacts.

8. A contactor assembly adapted for switching power to a circuit having a power source, the electrical assembly comprising:

a housing;

current carrying contacts disposed in the housing, the current carrying contacts having engagement ends with non-linear surfaces;

a coupling member, the coupling member having mating portions for engaging the non-linear surfaces of the current carrying contacts, the mating portions having grooves provided thereon, the groves extending from top surfaces of the mating portions toward bottom surfaces of the mating portions, the grooves having side walls extending to the top surfaces of the mating portions, the intersections of the side walls and top surfaces form contact edges;

an actuator assembly provided in the housing, the actuator assembly moves the coupling member between a closed position in which the mating portions of the coupling member are engaged with the current carrying contacts and an open position in which the mating portions of the coupling member are disengaged from the current carrying contacts;

wherein as the electrical assembly is moved to the closed position, the grooves of the mating portions of the coupling member are moved into engagement with the non-linear surfaces of the contacts, resulting in multiple contact points being provided between the non-linear surfaces of each respective contact of the current carrying contacts and the contact edges of each respective groove of the grooves of the mating portions, the contact edges are configured to pierce, break or penetrate any contaminant that may be present at the contact points.

9. The contactor assembly of claim 8, wherein a contact bridge extends from a first mating portion of the mating portions of the coupling member to a second mating portion of the mating portions of the coupling member.

10. The contactor assembly of claim 9, wherein the non-linear surfaces have a rounded configuration.

11. The contactor assembly of claim 10, wherein the grooves have side walls which extend to the top surfaces of the mating portions, the intersections of the side walls and top surfaces form contact edges.

12. The contactor assembly of claim 11, wherein the side walls extend at 90 degree angles from the top surfaces to form the contact edges.

13. The contactor assembly of claim 11, wherein the contact edges are rounded edges which extend between the side walls and the top surfaces.

14. The contactor assembly of claim 11, wherein the grooves extend in a direction which is parallel to a longitudinal axis of the coupling member.

15. A switch assembly adapted for switching power to a circuit having a power source, the switch assembly comprising:

fixed contacts, the fixed contacts having engagement ends with non-linear surfaces;

a movable coupling member, the movable coupling member having mating portions for engaging the non-linear surfaces of the fixed contacts, the mating portions having grooves provided thereon, the groves having contact edges, the movable coupling member movable between an open position in which the mating portions of the movable coupling member are disengaged from the fixed contacts and a closed position in which the mating portions of the movable coupling member are engaged with the fixed contacts;

wherein as the switch assembly is moved to the closed position, the contact edges of the mating portions of the movable coupling member are moved into engagement with the non-linear surfaces of the fixed contacts, resulting in multiple contact points being provided between the non-linear surfaces of each respective contact of the fixed contacts and the contact edges of each respective groove of the grooves of the mating portions, the contact edges are configured to pierce, break or penetrate contaminants that may be present at the multiple contact points.

16. The switch assembly of claim 15, wherein the non-linear surfaces of the fixed contacts have a rounded configuration.

17. The switch assembly of claim 16, wherein the grooves have side walls which extend to the top surfaces of the mating portions, the intersections of the side walls and top surfaces form the contact edges.

18. The switch assembly of claim 17, wherein the side walls extend at 90 degree angles from the top surfaces to form the contact edges.

19. The switch assembly of claim 17, wherein the contact edges are rounded edges which extend between the side walls and the top surfaces.

* * * * *